US005689908A

United States Patent [19]

Brandl

[11] Patent Number: 5,689,908

[45] Date of Patent: Nov. 25, 1997

[54] RIFLE CONSTRUCTION WITH SWING-TYPE BARREL

[75] Inventor: Rudolf Brandl, Dornhan, Germany

[73] Assignee: Heckler & Koch GmbH, Germany

[21] Appl. No.: 694,658

[22] Filed: Aug. 5, 1996

[30] Foreign Application Priority Data

Aug. 10, 1995 [DE] Germany ..... 195 29 483.1

[51] Int. Cl.[6] ..... F41A 21/48

[52] U.S. Cl. ..... 42/77; 42/75.02; 42/71.01

[58] Field of Search ..... 42/75.02, 75.04, 42/77, 75.01, 71.01

[56] References Cited

U.S. PATENT DOCUMENTS

| | | | |
|---|---|---|---|
| 294,581 | 3/1884 | Clough | 42/71.01 |
| 1,639,277 | 8/1927 | Soncini | 42/75.02 |
| 2,149,707 | 3/1939 | Murbach | 42/75.02 |
| 4,368,589 | 1/1983 | A'Costa | 42/77 |

*Primary Examiner*—Stephen M. Johnson

*Attorney, Agent, or Firm*—Leydig, Voit & Mayer, Ltd.

[57] ABSTRACT

A rifle construction with a swing-type barrel assembly is adapted for firing both conventional cartridges and non-conventional cartridges with a longitudinally extending barrel assembly having a first barrel and a second barrel mounted in opposed relation. A breech block interposed between the barrels is adapted for sliding cooperative movement with the first or second barrels in order to expel desired cartridges depending on the mode of operation. A housing is adapted to receive the barrel assembly in first and second firing positions.

20 Claims, 1 Drawing Sheet

RIFLE CONSTRUCTION WITH SWING-TYPE BARREL

FIELD OF THE INVENTION

This invention relates generally to the weaponry art, and more particularly to a rifle construction with a swing-type barrel assembly adapted for firing conventional and non-conventional cartridges.

BACKGROUND OF THE INVENTION

A user of a firearm often encounters different firing needs in different situations. It is therefore desirable that a singular firearm be adapted to fire different types of ammunition to enable selection of an appropriate ammunition type depending on the particular situation. In the past, various hunting rifles have been configured to combine several barrels of varying size in the form of "drop barrel bundles." Such hunting rifles offer a user the possibility of using different cartridges for different types of game. However, one significant drawback of these arrangements is that no repeating mechanism has been developed for use with the barrels of such rifles.

Repeating mechanisms, of course, are a desirable feature in rifles, particularly when used as assault weaponry. Prior attempts were therefore combined a repeating rifle designed for firing conventional or normal-caliber cartridges with an additional barrel designed for large-caliber cartridges, such as buckshot cartridges. These known arrangements, however, are generally cumbersome, complicated in operation, and expensive. As a result, they have not experienced a great degree of popularity, and their use has been generally restricted to collectors and the like.

Perhaps the only weapon of this kind which has come into relatively widespread use is a standard assault rifle equipped with a grenade launcher barrel mounted thereon, an example of which is described in German patent DE 32 02 806 C2. This document describes an assault rifle barrel that is primarily utilized. A relatively short grenade thrower barrel is mounted to the distal end of the shaft portion of the rifle barrel. The grenade launcher barrel is equipped with a separate breech block and trigger assembly. This arrangement further includes a special sighting arrangement designed for use in conjunction with the grenade launcher barrel and is mounted proximate to the normal sighting arrangement for the assault rifle. This assault rifle/grenade launcher combination, however, is quite cumbersome. Due to size and weight considerations, the grenade launcher barrel must be considerably shorter than the rifle barrel. The reloading sequence and mechanism for the grenade launcher is likewise rather complicated.

In addition to its inconvenience in use, this arrangement also provides unsatisfactory recoil impact. Due to the significant distance separating the normal-caliber rifle barrel and the grenade launcher barrel, it is difficult to achieve optimized recoil characteristics for both barrels. For example, when the position of the normal-caliber rifle barrel is arranged so that the recoil force is transferred in a desirable manner to the shoulder of the user, then the recoil force generated by the grenade launcher is transferred in an unsuitable manner. The heavy weight, inconvenient handling, and unbalanced recoil impact are principle reasons that such a combination rifle is unpopular with operators, and as a result is rarely used.

Although past efforts to combine rifle barrels of different calibers generally have produced unsatisfactory results, the need for such combination weapons remains. For example, large-caliber rifle cartridges that deploy so called "intelligent ammunition" have been developed. As used herein, "intelligent ammunition" is intended to mean a type of ammunition which, possibly in cooperation with a guidance system mounted on the weapon, automatically locks onto a target, thereby providing considerably improved targeting accuracy. If a weapon for firing such "intelligent ammunition" can be effectively combined with an assault rifle, the resulting weapon can be very versatile and very powerful.

SUMMARY OF THE INVENTION

In view of the foregoing, it is a general object of the present invention to provide a self-loading rifle that is capable of firing cartridges of different sizes in various modes and that is relatively simple in construction and in use, easy to handle, and can be readily switched between the various firing modes, so as to provide the user of the rifle greater ability of self-defense as compared to prior art combination rifles.

It is another object of the present invention to provide a self-loading combination rifle for firing both normal-caliber and large-caliber cartridges that has optimized recoil characteristics regardless of the type of cartridge being fired.

It is an object of the present invention to provide a self-loading combination rifle for firing both normal-caliber and large-caliber cartridges that has a simple structure and low weight so that the rifle is easy to manufacture, simple to maintain and convenient to carry.

It is a related object of the present invention to provide such a self-loading combination rifle that has a relatively simple triggering mechanism and a straightforward sighting arrangement.

In accordance with these and other additional objects, a combination rifle construction of the present invention comprises a longitudinally extending "swing-type" barrel assembly and a housing adapted to receive the barrel assembly in first and second operative modes. The barrel assembly includes a conventional or normal-caliber rifle barrel and a non-conventional or large-caliber rifle barrel disposed in back-to-back relation such that their respective cartridge chambers are proximate to each other while their respective barrel ends are oriented in opposite directions. The rifle housing has a recess disposed to lockingly engage the barrel assembly in first and second firing modes. In the first operative mode, the housing supports the normal-caliber rifle barrel in an operative position, while the large-caliber rifle barrel is received within the housing recess in an inoperative position. In the second operative mode, the barrel assembly is rotated 180 degrees such that the housing supports the large-caliber rifle barrel in an operative position, while the normal-caliber rifle barrel is received within the housing recess in an inoperative position.

In the preferred implementation, the first and second rifle barrels are substantially coaxially aligned. The barrel assembly further includes a guide member that interconnects the normal-caliber barrel with the large-caliber barrel. The guide member also supports breech block or locking member adapted for sliding movement between the respective cartridge chambers of the two barrels. The breech block has a large-caliber bolt head at its one end and a normal-caliber bolt head at its other end which cooperate with the respective rifle barrels during operation. The rifle has a single sighting device mounted to the top of the housing, and a trigger assembly with a single hammer for use in either operative mode.

Other objects and advantages will become apparent with reference to the following detailed description when taken in conjunction with the drawings, in which:

Figure 1:
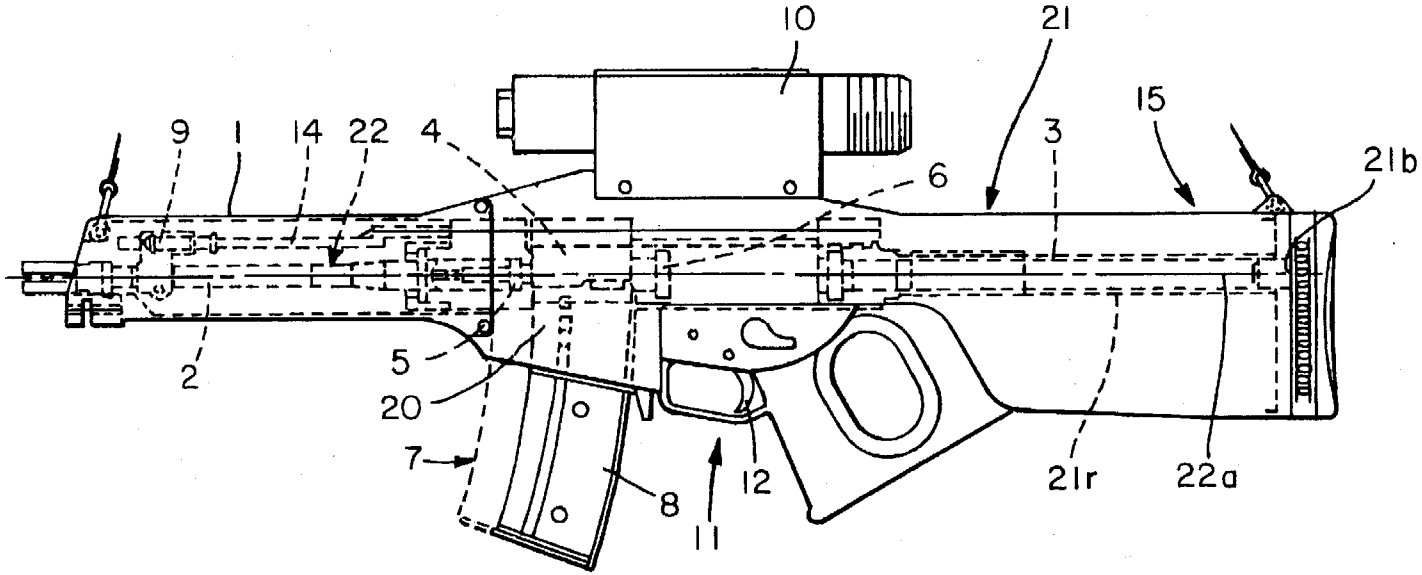
FIG. 1 is a side view of an embodiment of a rifle construction with a swing-type barrel assembly according to the present invention in a first operative mode.
Figure 2:
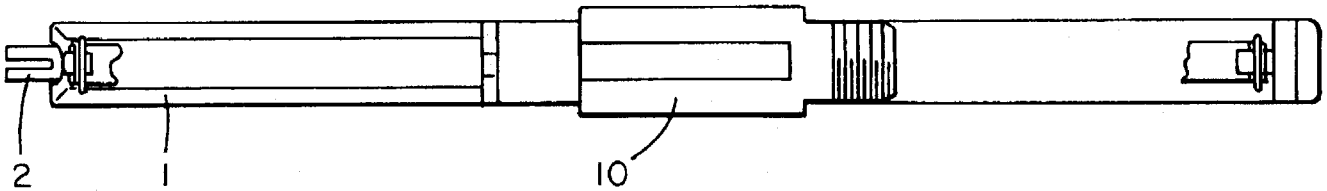
FIG. 2 is a top view of the rifle construction of FIG. 1.

While the invention is susceptible of various modifications and alternative constructions, certain illustrated embodiment hereof has been shown in the drawings and will be described below. It should be understood, however, that there is no intention to limit the invention to the specific embodiments disclosed herein. To the contrary, the invention is intended to cover all modifications, alternative constructions and equivalents falling within the spirit and the scope of the invention as defined by the appended claims.

DETAILED DESCRIPTION OF THE PREFERRED EMBODIMENT

Turning now to the drawings, FIG. 1 shows a rifle construction embodying the present invention. The invention is particularly suited for use as an assault weapon that is readily adaptable to varying situations encountered.

The rifle includes a housing 21 and a longitudinally extending barrel assembly 22 received within a recess 21*r* formed in the housing. In the preferred embodiment, the housing recess 21*r* substantially coincides with the lengthwise dimension of the barrel assembly 22. The housing 21 includes a hand guard 1 at one of its ends and a shoulder support or stock 15 at its opposite butt end. FIG. 1 also shows a trigger assembly 11 mounted to the housing intermediate the hand guard and the shoulder support and a corresponding trigger 12. A magazine shaft 20 disposed proximate to the trigger 12 receives cartridge magazines of different types. As will be described in greater detail below, the magazine shaft 20 is configured to receive either a conventional (slightly curved) magazine 8 containing normal-caliber cartridges, as illustrated in FIG. 1. Alternatively, the magazine shaft 20 is adapted to receive a non-conventional magazine 7 containing large-caliber cartridges, such as the magazine shown in phantom lines in FIG. 1. In addition, FIG. 1 illustrates sighting apparatus 10 mounted to the top side of the housing 21 to facilitate the aiming of the weapon.

Figure 3:
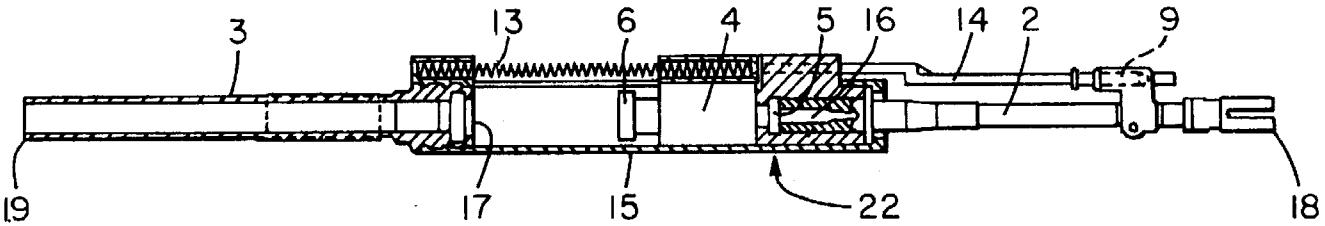
FIG. 3 is a side view of a swing-type barrel assembly used in the rifle construction of FIG. 1.

FIG. 3 illustrates the barrel assembly 22 according to the present invention in greater detail. The barrel assembly 22 is a "swing-type" assembly which comprises opposed first and second barrels 2,3 preferably aligned along a barrel axis 22*a*. The first barrel 2 is preferably a conventional or normal-caliber rifle barrel having a cartridge chamber 16 at its proximal end and a flash damper and muzzle 18 at its distal end. The second barrel 3 is a non-conventional or a large-caliber rifle barrel similarly configured with a cartridge chamber 17 at its proximal end. FIG. 3 also shows a breech block guide member 15, disposed intermediate to, and interconnecting the first and second barrels 2, 3. The normal-caliber barrel 2 is secured to one end of the block guide member 15 (e.g., by means of a clamping nut). The large-caliber barrel 3 is similarly secured to the opposite end of the block guide member 15. The first and second barrels are thus secured to the guide 15 such that their respective cartridge chambers 16, 17 are proximate to each other while their respective distal or muzzle ends 18, 19 are oriented in opposed relation along the barrel axis 22*a* for ready interchangeability, as discussed below.

The term "rifle barrel" as used herein is intended to denote a barrel which is arranged for direction-controlled firing of a projectile, in contrast to the barrel of a firearm that has relatively poor direction control, such as the cone of a shot gun. The conventional or normal-caliber barrel 2 is preferably sized for firing any one of several common cartridge types such as the 0.308 Winchester cartridges or the 7.62 millimeter Kalaschnikov cartridges. In the preferred embodiment, the normal-caliber barrel 2 is sized for firing 0.223 cartridges or cartridges of a similar but possibly slightly smaller size, such as the 5.45 millimeter Kalaschnikov or 4.6×36 (millimeter) cartridges. The use of cartridges of a relatively small size permits a small barrel diameter, thereby reducing the overall weight of the barrel assembly 22.

The large-caliber rifle barrel 3 is preferably arranged for firing cartridges of a caliber on the order of 20 to 25 millimeters. As an example, such cartridges may contain intelligent ammunition. The large-caliber rifle barrel 3 is sufficiently sturdy in construction to withstand higher gas pressures than ordinarily generated by shot gun cartridges. Preferably, the large-caliber rifle barrel 3 has spiral rifling in its bore. Alternatively, the invention contemplates use of a large-caliber barrel having a smooth bore or with spaced axial riflings without departing from the spirit and scope of the present invention.

In the illustrated embodiment, the first and second rifle barrels 2, 3 are substantially coaxially aligned. A breech block or lock 4 is mounted to the breech block guide 15 and is adapted for sliding movement between the cartridge chambers 16, 17 of the respective rifle barrels 2, 3. In this regard, the cartridge chambers 16, 17 are preferably separated by a distance corresponding at least to the recoil distance of travel of the block 4 taking into account the length of the block 4. As illustrated in FIG. 3, the block 4 includes a large-caliber bolt head 6 disposed on the block end facing the large-caliber barrel 3, and a normal-caliber bolt head 5 on the block end facing the normal-caliber barrel 2. The bolt heads 5, 6 are structurally and functionally adapted for engaging the respective barrels during a firing sequence as will be understood by those skilled in the art.

In order to operate the rifle of the present invention, the barrel assembly 22 is placed within the housing 21 in a desired firing mode. In the conventional firing mode illustrated in FIG. 1, the barrel assembly 22 is received in the housing such that the normal-caliber barrel 2 is oriented in an operative position for firing, and the large-caliber barrel 3 is in an inoperative position. In a second firing mode, the barrel assembly 22 is rotated 180 degrees so that the large-caliber barrel 3 is oriented in an operative position, and the normal-caliber barrel 2 is in an inoperative position. By virtue of the opposed or back-to-back configuration of the two barrels, when one barrel is located in its firing position, the opposed barrel is retentively engaged within the housing recess 21*r* portion located in the shoulder support 15. In the inoperative position, the distal ends of the respective barrels 2, 3 are disposed in abutting relation against a buffer 21*b* disposed in the housing. This construction provides additional structural support for the rifle particularly during recoil.

One feature of the preferred embodiment of the present invention is the ease in which the barrel assembly is removed from the housing 21. In order to switch the barrel in use, an operator merely removes the barrel assembly 22 from the housing recess 21*r*, reverses it, and re-inserts the assembly into the housing recess. A locking detent may be preferably implemented to retentively engage the barrel assembly 22 in the desired firing position. The removal of the rifle assembly 22 from the housing 21 and its reinstallation is thus accomplished by releasing the detent. When the barrel assembly 22 is inserted into the housing 21 and assumes a firing position, the detent automatically snaps into engagement with and securely holds the barrel assembly within the housing recess 21r. Accordingly, the barrel configuration of the invention provides a very simple construction which avoids entirely the complicated barrel changing mechanisms used in the prior art.

The unique arrangement of the barrels also enables the use of a single block 4 which is movable along the barrel axis to coact with one of either the first or second barrels 2,3. In one embodiment, the rifle is constructed so that the block remains within the housing 21 when the barrel assembly 22 is removed. In the preferred embodiment, however, the block 4 is slidably mounted to the block guide 15 permitting axial movement between the first and second barrels 2,3. FIGS. 1 and 3 illustrate the block 4 moved to the position in which the conventional bolt head 5 is in abutment with the proximal end of the normal-caliber barrel 2. Of course, when the large-caliber mode is utilized, the breech block 4 axially is moved toward the large-caliber barrel until the large-caliber bolt head 5 is in abutment with the proximal end of the large-caliber barrel 3.

Another specific feature of the preferred embodiment is the provision for self-loading at least in conjunction with the normal-caliber barrel 2. In the illustrated embodiment, the normal-caliber barrel 2 is coupled with a gas-controlled unbolting or repeating mechanism. In this regard, a gas vent depending from the normal-caliber barrel 2 is in fluid communication with a gas cylinder 9. A recoil spring 13 biases the breech block 4 toward the normal-caliber barrel 2, which provides a biasing force that tends to urge the breech block and bolt head 5 against the cartridge chamber 16 of the normal-caliber barrel. An operating rod 14 extending parallel to the normal-caliber barrel 2 is coupled with the breech block 4 at one end. The operating rod 14 is actuated by the gas cylinder which provides a piston at the opposite end of the operating rod 14. The operating rod 14 is slidably seated in the block guide 15 so that, when actuated, it unbolts the normal-caliber rifle by urging the breech block 4 and bolt head 5 away from the cartridge chamber in a manner known to people skilled in the art. In this way, when sufficient gas pressure is generated in the gas cylinder 9 as a result of firing a normal-caliber cartridge, the normal-caliber bolt head 5 is automatically unbolted, and the breech block 4 executes opening movement against the force of the recoil spring 13. This enables the next cartridge to be moved to the staging area and ultimately to the cartridge chamber 16.

The large-caliber bolt head 6, in contrast, is preferably manually bolted and unbolted with the use of a handle (not shown) designed to enable axially movement of the breech block 4 in a manner known to those skilled in the art. In this way, the breech block 4 acts as a manually operated cylinder block or repeating block that cooperatively engages the large-caliber barrel 3 during firing. Thus, the handle allows the user to manually to lock and unlock the large-caliber bolt head 6 against the cartridge chamber 17 of the large-caliber barrel. Manual control of breech block movement when the large-caliber barrel 3 is used is advantageous in view of the high recoil force generated by firing a large-caliber cartridge. Otherwise, the implementation of a repeating rifle mechanism capable of withstanding the high recoil force would result in an assault weapon that is somewhat expensive and heavy.

In the illustrated embodiment, the rifle has a single magazine shaft 20 which is adapted to engage a normal-caliber cartridge magazine 8, or alternatively, a large-caliber cartridge magazine 7. The side of the breech block 4 facing the magazine shaft 20 is constructed in an appropriate manner, such as by keying or the like, so that when the normal-caliber barrel 2 is disposed in its firing position as (illustrated in FIG. 1), only the normal-caliber magazine 8 can be properly engaged within the magazine shaft. That is, the large-caliber magazine 7 is prevented from engagement within the magazine shaft 20 when the normal-caliber barrel 2 is in its operative position. Protrusions, steps or the like can be used to ensure that the normal-caliber barrel 2 cannot be installed in its firing position when a large-caliber magazine 7 is present in the magazine shaft 20. Likewise, the large-caliber rifle barrel 3 is inhibited from being installed in its firing position when a normal-caliber magazine is located in the magazine shaft 20. The inadvertent use of the rifle with an improper cartridge magazine is therefore avoided.

Inasmuch as the construction of the rifle of the present invention allows the user to hold the rifle in the same manner regardless of the barrel in use, a single sighting device 10 mounted on the housing can be employed for aiming the rifle in either operative mode. The sighting device 10 preferably includes a distance-measuring device or range finder, which preferably is a laser range finder. The distance-measuring device precisely determines the distance between the target and the rifle. This is useful because the varying trajectories of the projectiles employed. That is, the trajectory of the projectile fired from the large-caliber barrel 3 is typically relatively strongly curved as compared with a conventional projectile trajectory. Accordingly, precise measurement of the target distance enhances targeting accuracy, particularly at greater target distances.

The distance-measuring device is preferably adapted to automatically adjust its display according to the rifle barrel currently in the "use" position. This is accomplished, for example, with the employment of a barrel sensor mounted on the housing 21 that detects the barrel type located in the operative position and generates a signal accordingly. The optical sighting device 10 receives the signal from the barrel sensor and utilizes this information together with the measured distance of the target to indicate a suitable holding point to the user.

When either of the barrels is in its rest or inoperative position inside the housing, it is received in the housing recess portion in the shoulder support 15. As noted above, this arrangement provides added structural support that transfers recoil forces to the shoulder of the user. Because the barrel received in the shoulder support 15 provides sufficient structural strength to withstand the recoil force, the shoulder support can be of relatively lightweight construction. The reduced weight of the shoulder support 15 offsets any increased weight of multiple barrels. In this way, the combination rifle of the present invention can be constructed to have a weight that differs only slightly from that of a conventional assault rifle.

In the illustrated embodiment, the trigger assembly 11 includes a single hammer (not shown) which is located in the housing of the weapon. The breech block 4 has a firing pin (not shown) which is located in a through hole disposed in the breech block 4. The firing pin is sized to be of a slightly greater dimension than the breech block 4 such that, when the normal-caliber barrel 2 is in use and the breech block 4 is bolted against the cartridge chamber 16, as illustrated in FIG. 1, the firing pin protrudes slightly outwardly from the opposite end of the breech block 4, which in this case is the large-caliber bolt head 6. The firing pin thus can be driven forward by the hammer of the trigger assembly 11 to fire the cartridge in the normal-caliber barrel 2. The firing of the cartridge causes the gas operated self-loading process to take place in a manner known to people skilled in the art. The trigger assembly 11 can be equipped with a switch to select the desired firing mode including single shot firing, semi-automatic operation or continuous or fully automatic firing.

In order to employ the use of large-caliber cartridges, the barrel assembly 22 is removed from the housing 21 of the rifle and rotated 180 degrees so that the large barrel 3 is oriented in a forward position. The barrel assembly 22 is then reinstalled within the housing recess 21*r*. This installation is preferably accomplished after the conventional or normal-caliber magazine 8 is removed from the magazine shaft 20. After the large-caliber barrel 3 is properly mounted in the operative position, the large-caliber magazine 7 is inserted into the magazine shaft 20. The barrel sensor detects the presence of the large-caliber barrel 3 and provides an appropriate signal to cause the sighting device 10 to switch to a sighting mode suitable for large-caliber operation.

After the large-caliber magazine 7 is engaged, the breech block 4 is thrust toward the large-caliber barrel 3 by means of the handle against the biasing force of the recoil spring 13 until the bolt head 6 abuts the cartridge chamber 17. When the breech block 4 has reached the end of its travel, the large-caliber bolt head 6 is locked in position by suitable manual locking means. With the breech block 4 in this position, the firing pin protrudes outward from the normal-caliber bolt head 5 and can be struck by the hammer in order to fire the large-caliber cartridge.

In order to remove the fired cartridge, the user unlocks the bolt head 6 by appropriate manipulation of the handle. The recoil spring 13 then urges the breech block 4 back away from the large-caliber barrel 3, thereby ensuring a flawless ejection of the empty cartridge case.

Accordingly, a combination rifle construction meeting the aforestated objectives has been described. The rifle construction is relatively lightweight, while at the same time, provides ready firing of both conventional caliber and non-conventional caliber cartridges in various operable modes. In addition, the rifle construction provides increased support.

What is claimed is:

1. A combination rifle construction adapted to fire cartridges of a first caliber in a first operable mode and cartridges of a second caliber in a second operable mode, comprising:

a longitudinally extending barrel assembly including a first rifle barrel disposed at one end of the assembly and a second rifle barrel disposed at the opposite end of the assembly, each of said barrels disposed in back-to-back relation; and a rifle housing including a recess adapted for alternatively engaging the barrel assembly in the operable modes such that, in the first operable mode, the first rifle barrel is oriented for firing cartridges of said first caliber while the second rifle barrel is received within the housing, and in the second operable mode, the second rifle barrel is oriented for firing cartridges of said second caliber while the first rifle barrel is received within the housing.

2. The invention as in claim 1 wherein the first caliber is smaller than the second caliber.

3. The invention as in claim 2 wherein the second rifle barrel is a large-caliber barrel adapted to fire large-caliber cartridges.

4. The invention as in claim 3, wherein said first and second rifle barrels are substantially coaxial and each having a cartridge chamber, and wherein the barrel assembly further includes a guide member interconnecting the first and second rifle barrels at the respective cartridge chambers of said rifle barrels, and a breech block slidably mounted on the guide member adapted for movement between the cartridge chambers of the respective rifle barrels and cooperating engagement with each said rifle barrel for firing thereof, the cartridge chambers of the rifle barrels being separated by a distance corresponding to a recoil distance of the breech block.

5. The invention as in claim 4, wherein the breech block has a first caliber bolt head facing the cartridge chamber of the first rifle barrel and a second caliber bolt head facing the cartridge chamber of the second rifle barrel.

6. The invention as in claim 5, wherein the barrel assembly includes a gas vent depending from the first barrel, a gas cylinder connected thereto, and an operating rod coupled to the breech block for unbolting the first caliber bolt head upon actuation of the gas cylinder, and a recoil spring for biasing the breech block toward the first rifle barrel.

7. The invention as in claim 6, wherein the second caliber bolt head is movable for bolting and unbolting thereof and for sliding the breech block in the barrel assembly by hand manipulation.

8. The invention as in claim 3, including a magazine shaft disposed in the housing and adapted for receiving both a first caliber cartridge magazine and a second caliber cartridge magazine.

9. The invention as in claim 3, wherein the first rifle barrel is sized for firing rifle cartridges dimensioned about 0.233 caliber, and the second rifle barrel is sized for firing cartridges of a caliber from 20 mm to 25 mm.

10. The invention as in claim 3, further including a sighting system including a sighting device mounted on the housing.

11. The invention as in claim 10, wherein the sighting system measures the distance between the rifle and a target.

12. The invention as in claim 10, wherein the sighting system detects which of said rifle barrels is oriented for firing and adjusts a display operating mode of the sighting device accordingly.

13. A self-loading combination rifle construction adapted to fire cartridges of a first caliber in a first operative mode and cartridges of a second caliber in a second operative mode, comprising:

a longitudinally extending barrel assembly including a first rifle barrel disposed at one end of the assembly and a second rifle barrel disposed at the opposite end of the assembly, each of said barrels having a muzzle and a cartridge chamber disposed such that their respective cartridge chambers are disposed proximate to each other while their respective muzzles are oriented in opposite directions;

a rifle housing including a recess adapted for releasable engagement with the barrel assembly such that, in the first operable mode, the first rifle barrel is oriented for firing cartridges of said first caliber while the second rifle barrel is received within the housing, and in the second operable mode, the second rifle barrel is oriented for firing cartridges of said second caliber while the first barrel is received within the housing; and a repeating mechanism including a gas cylinder fluidly coupled to said first rifle barrel and operatively engaged with a breech block in the barrel assembly, the repeating mechanism disposed to self load cartridges of said first caliber in the first operative mode.

14. A swing-type barrel assembly for use in a rifle including a rifle housing having a recess formed therein comprising:

a first longitudinally extending barrel;

a second longitudinally extending barrel disposed in back-to-back relation with respect to the first barrel; and means for coupling the first and second barrels, the assembly adapted for releasable engagement within the housing such that, in a first operative mode, the first barrel is oriented outwardly from the housing for firing while the second barrel is received within the housing recess, and in a second operable mode the assembly is rotated 180 degrees such that the second barrel is oriented outwardly from the housing for firing while the first barrel is received within the housing.

15. The invention as in claim 14 wherein one of said first and second rifle barrels is adapted to fire large-caliber cartridges.

16. The invention as in claim 15, wherein the first and second rifle barrels are substantially coaxially aligned along a barrel axis, and wherein the means for coupling includes a guide connecting the first and second barrels and a breech block slidably mounted to the guide and movable between the rifle barrels to cooperate with each said rifle barrel for firing thereof.

17. The invention as in claim 16, wherein the barrel assembly includes a repeating mechanism provided with a gas cylinder fluidly coupled with the first rifle barrel and operatively engaged with the breech block for self loading cartridges into the first rifle barrel in the first operative mode.

18. The invention as in claim 14, wherein the first rifle barrel is sized for firing 0.223 caliber rifle cartridges, and the second rifle barrel is sized for firing cartridges of a caliber from 20 mm to 25 mm.

19. The invention as in claim 14 wherein the barrel assembly is adapted for use with a sighting apparatus mounted on the housing.

20. The invention as in claim 19, wherein the sighting apparatus receives a sensing signal indicative of whether either one of the rifle barrels is in use.

* * * * *